US005230152A

United States Patent [19]

Kennedy

[11] Patent Number: 5,230,152

[45] Date of Patent: Jul. 27, 1993

[54] DUAL BLADE UTILITY KNIFE

[76] Inventor: Michael J. Kennedy, 721 Main St. Apt. 2, Bentleville, Pa. 15314

[21] Appl. No.: 802,408

[22] Filed: Dec. 4, 1991

[51] Int. Cl.[5] ..... B26B 1/08

[52] U.S. Cl. ..... 30/162; 30/335

[58] Field of Search ..... 30/152, 162, 329, 335

[56] References Cited

U.S. PATENT DOCUMENTS

| | | | |
|---|---|---|---|
| 373,580 | 11/1887 | Boynton | 30/162 |
| 2,736,960 | 3/1956 | Armstrong | 30/335 |
| 3,192,624 | 7/1965 | Gringer | 30/162 |
| 3,660,896 | 5/1972 | Umholtz | 30/335 |
| 4,209,900 | 7/1980 | Gilbert | 30/162 |
| 4,509,260 | 4/1985 | Gringer | 30/335 |

*Primary Examiner*—Frank T. Yost
*Assistant Examiner*—Hwei-Siu Payer
*Attorney, Agent, or Firm*—William J. Ruano

[57] ABSTRACT

A knife has a dual blade assembly slidable in a cover so as to be selectively projectable beyond either end of the cover. An actuator, within the cover, has supports on the ends thereof for supporting two blades of any type. Thus, a plain blade may be supported on one end of the actuator and the hooked blade may be supported on the other, or two blades of the same type may be supported instead.

1 Claim, 2 Drawing Sheets

DUAL BLADE UTILITY KNIFE

This invention relates to a slidable blade type utility knife.

BACKGROUND OF THE INVENTION

In the past, a dividable single blade utility knife has been used having the disadvantage of requiring the substitution of the blade whenever a different type of blade was required for the cutting task to be performed, such as the substitution of a hooked blade for a plain blade. Such substitution requires time as well as subjecting the worker to cutting his finger in the course of such substitution.

SUMMARY OF THE INVENTION

An object of the present invention is to overcome the above-mentioned disadvantage by providing an novel dual blade utility knife of the slidable blade type having a different blade at each end of the housing, or the same blade in some cases, to save time during working and to perform better cutting tasks, as well as to enable quick substitutions of blades of different types.

DETAILED DESCRIPTION OF THE PREFERRED EMBODIMENT

Figure 1:
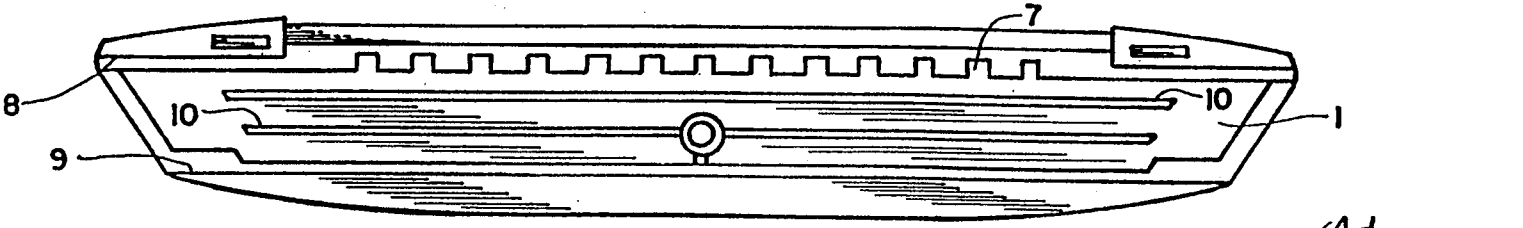
FIG. 1 is a plan view of the bottom half of the cover of a novel dual blade holder and actuator embodying the present invention.
Figure 5:
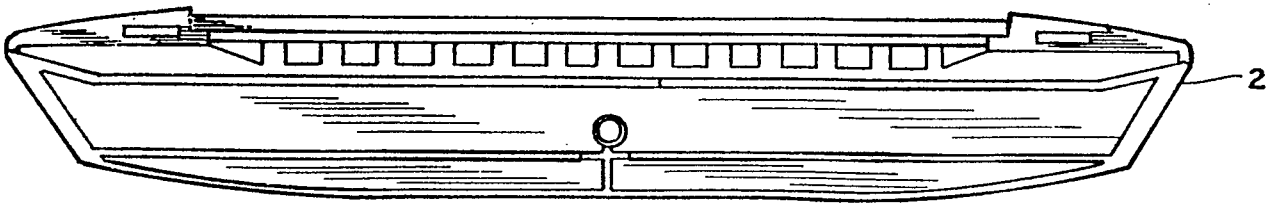

Referring to FIG. 1, numeral 1 denotes the interior of the bottom half of the cover and numeral 2 in FIG. 5 denotes that of the top half of the cover, both of which may be made of metal or, in some cases, plastic material. A screw (not shown) extends through a screw threaded opening, shown in FIG. 1, to firmly clamp the top and bottom halves together.

Figure 6:
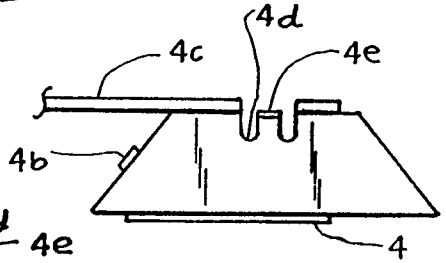
FIG. 5 is a plan view of the top half of the cover and FIG. 6 is an enlarged, fragmentary view showing a blade mounted on the actuator 4.
Figure 4:
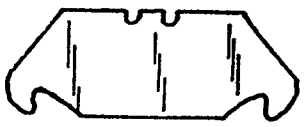
FIG. 3 and 4 show two different types of blades mounted on the end portions of the actuator.
Figure 2:
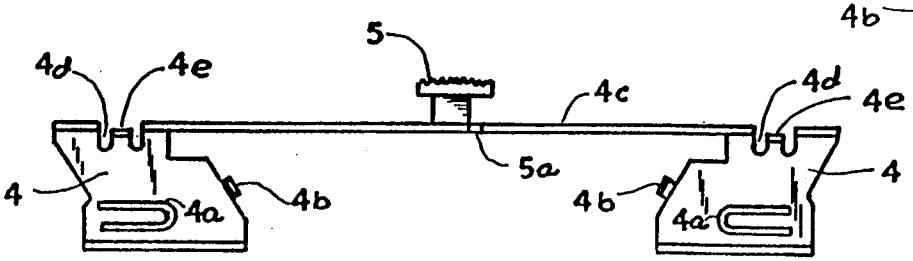
FIG. 2 is a plan view of the actuator.
Figure 3:
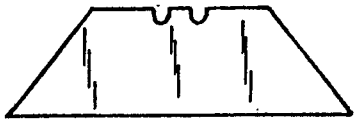
Figure 7:
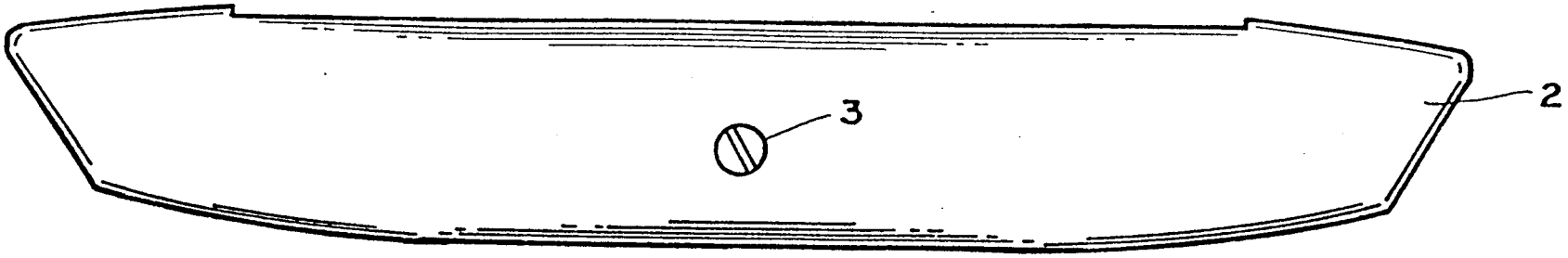

FIG. 2 shows an actuator and FIG. 7 is an exterior plan view of the top half of the cover, embodying the present invention, on which blades, such as shown in FIG. 3 and FIG. 4, may be mounted. The top edge 4*c* of the actuator slides along the top ledge 8, in FIG. 1, while the bottom edge of the actuator 4 slides on the bottom ledge 9 shown in FIG. 1. Numeral 5 denotes an operating button or handle of the actuator rigidly connected to the center of a springy top portion 4*c* of the actuator. Lateral projections 5*a* project from both sides of the button or handle 5 so as to be selectively engageable in slots 7, shown in FIG. 1, as well as corresponding slots contained inside the top cover 2. U-shaped slots 4*a* having a pair of blade supports 4 having upper slots 4*d* urge the blade against ribs 10 which confront it. Lateral projections 4*b* are provided on the actuator to serve as stops for supporting the slanted right edge of either a plain blade, as shown in FIG. 3 and FIG. 6 or a hooked blade, as shown in FIG. 4. Projections 11, 11*a* engage slots 12, 12*a*.

A blade shown in FIG. 3 may be mounted on one side of the actuator 4 while a blade as shown in FIG. 4 may be mounted on the other side of the actuator, in which event the left tapered edge of the blade shown in FIG. 4 would rest against the lateral projection 4*b* shown at the right of the actuator.

In operation, the actuator shown in FIG. 2 is mounted on the bottom half of the cover 1, shown in FIG. 1, in a manner that the top edge of springy strip 4*c* will slide against top ledge 8, and the bottom edge of the actuator will slide along the top of the bottom ledge 9, for selective lateral sliding engagement, left or right. After such mounting of the actuator inside both the top and bottom halves 2 and 1 and after the screw 3 is screw threaded to the opening in FIG. 1, the actuator is in readiness for operation.

In order to move the actuator either to the left or the right, the operating bottom or handle 5 is pushed downwardly to flex the springy top portion 4*c*, after which the actuator is free to be selectively moved either to the left or to the right, depending upon which blade is to be used by projecting it beyond the end of the covers 1 and 2. When either the blade shown in FIG. 3 or that shown in FIG. 4 is mounted on the actuator, a lateral projection 4*e*, projecting form both sides of the actuator, will engage one of the top slots, shown in FIGS. 3 and 4, to lock the blade to the actuator.

After the actuator is moved sufficiently to the left or to the right to effect projection of the blade from either end of the cover 1, it may be moved back to normal central position by pushing down on button 5 against the tension of spring 4*c* until the proper central opening 7 is located on both sides of the cover halves 1 and 2.

While I have illustrated and described a single specific embodiment of my invention, it will be understood that this is by way of illustration only and that various changes and modifications may be complemented in my invention within the scope of the following claims.

I claim:

1. A dual blade utility knife comprising cover halves secured together, an actuator laterally slidable in said cover halves, said actuator having a pair of blade supports, a springy central portion supporting said blade supports, a pair of blades, each supported on one of said blade supports, an operating handle projecting upwardly centrally of said actuator and exteriorly of said cover halves for downwardly deflection of said springy central portion by said handle and for selectively moving said actuator in either longitudinal direction for selective projection of said blade supports and blades by said operating handle from either lateral end of said cover halves, and wherein longitudinally spaced and confronting slots are provided along the top interiors of said cover halves, lateral projections extending from both sides of said springy central portion for selective projection into said confronting slots after downward deflection of said springily central portion, whereby said actuator is securely held selectively in a central position or longitudinally extended position beyond either the end of said cover halves, and wherein said blade supports include a lateral projection for supporting an edge of the supported blade and wherein each of said blade supports includes a second lateral projection at the top of each support, each of said blades including an upper opening through which said second lateral projections are inserted, together with a screw extending through said cover halves centrally thereof.

* * * * *